United States Patent [19]

Ohsaki

[11] Patent Number: 4,645,364

[45] Date of Patent: Feb. 24, 1987

[54] INK RIBBON CARTRIDGE

[75] Inventor: Ryouhei Ohsaki, Tokyo, Japan

[73] Assignee: OKI Electric Industry Co., Ltd., Tokyo, Japan

[21] Appl. No.: 779,791

[22] Filed: Sep. 24, 1985

[30] Foreign Application Priority Data

Sep. 26, 1984 [JP] Japan ..... 59-144210[U]

[51] Int. Cl.[4] ..... B41J 32/02; B41J 35/08

[52] U.S. Cl. ..... 400/248; 400/196.1; 400/208

[58] Field of Search ..... 400/196.1, 248, 208

[56] References Cited

U.S. PATENT DOCUMENTS

| | | | |
|---|---|---|---|
| 3,726,381 | 4/1973 | Murphy | 400/248 |
| 3,830,351 | 8/1974 | Cappotto | 400/248 |
| 3,977,512 | 8/1976 | Teagarden et al. | 400/248 |
| 3,989,132 | 11/1976 | Carson, Jr. | 400/196.1 |

FOREIGN PATENT DOCUMENTS

| | | | |
|---|---|---|---|
| 2328442 | 1/1974 | Fed. Rep. of Germany | 400/196.1 |
| 2551989 | 5/1976 | Fed. Rep. of Germany | 400/196.1 |
| 57-57954 | of 1982 | Japan | 400/196.1 |
| 59-95181 | 6/1984 | Japan | 400/196.1 |

*Primary Examiner*—William Pieprz

*Attorney, Agent, or Firm*—Wenderoth, Lind & Ponack

[57] ABSTRACT

A fan-folded type ink ribbon cartridge in which an ink ribbon is regularly folded to have a constant width and is enclosed in an enclosing space of a cartridge casing. This cartridge is provided with a plurality of projections which are arranged to face one another on the mutually facing inner surfaces of the cartridge casing near the outlet of the enclosing space of the cartridge casing. Each gap which is formed by the projections facing each other is set to be more narrow than the folding width of the ink ribbon. These gaps may be set to be constant or they may be set so as to gradually become more narrow towards the outlet of the enclosing space. The ink ribbon is hooked by the projections and the folding width is gradually reduced, so that the ink ribbon can be stably pulled out with minimal load variation. In addition, the ink ribbon is prevented from falling down due to the pressure of the inlet side of the enclosing space or due to the weight of the ribbon itself.

5 Claims, 4 Drawing Figures

INK RIBBON CARTRIDGE

BACKGROUND OF THE INVENTION

The present invention relates to a fan-folded type ribbon cartridge for use in a printer.

In general, what are called fan-folded type ribbon cartridges in which an ink ribbon is regularly folded with a constant width and is enclosed in a cartridge casing are constructed as follows: namely, the ink ribbon is regularly folded in a zigzag line and is enclosed in the enclosing space provided in the central portion of a cartridge casing. A part of this ink ribbon is pulled out to the outside from the pull-out port which is protrudingly formed at one end of the cartridge casing. Then the ink ribbon is again taken into the cartridge casing from the take-in port which is likewise protrudingly formed at the other end of the cartridge casing. In order to prevent the ink ribbon from being erroneously drawn in the overlapped state when the ink ribbon is pulled out from the enclosing space in the cartridge casing, hitherto, projections are formed on the bottom and top surfaces of the cartridge casing, near the outlet of the enclosing space such that they face each other, and the gap between the above-mentioned projections is set to be smaller than the width of the ink ribbon. With this arrangement, the ink ribbon is hooked by the projections, thereby realizing a smooth ribbon feed.

However, in such a conventional system, an ink ribbon which has been used almost until its life, cannot be held by those pair of projections due to various reasons such as decrease in width dimension of the ink ribbon because of the tension applied for a long time, reduction in rigidity of the base material of the ink ribbon as a result of the repeated impacts of the printing elements, and so forth. Consequently, problems are encountered such as an overlapping pull out of the ink ribbon, falling down or twisting of the ribbon in the cartridge casing, and folding of the ink ribbon when the ink ribbon is being pulled out from the enclosing space of the cartridge casing.

SUMMARY OF THE INVENTION

Accordingly, it is an object of the present invention to provide an ink ribbon cartridge in which, by gradually reducing the folding density of an ink ribbon, a load variation on the ink ribbon is suppressed thereby enabling the ink ribbon to be stably pulled out.

This end, according to the invention, there is provided an ink ribbon cartridge having a plurality of opposed projections having gaps therebetween arranged such as to face one another on the mutually opposing inner surfaces of the cartridge casing near the outlet of the enclosing space of the cartridge casing, each of the gaps formed between adjacent projections being set to be narrower than the folding width of the ink ribbon.

According to the invention, the folded ink ribbon in the enclosing space of the cartridge casing is hooked by the projections such that the folding density of the ink ribbon is gradually reduced by these projections. The ink ribbon is then pulled out through the pull-out port of the cartridge casing and is again taken into the enclosing space of the casing through the take-in port of the casing.

The above and other objects, features and advantages of the invention will be more apparent from the following detailed description when the same is read in conjunction with the accompanying drawings.

DESCRIPTION OF THE PREFERRED EMBODIMENTS

Figure 1:
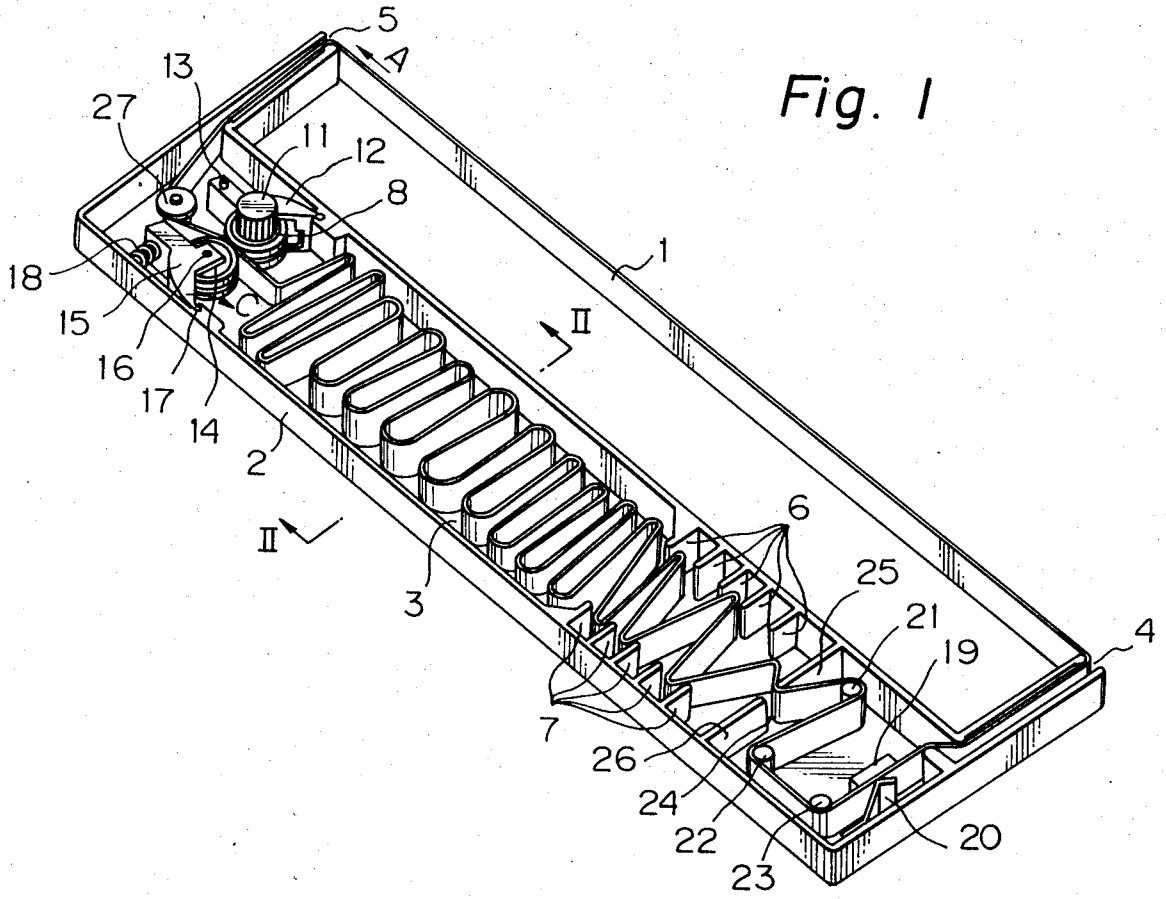
FIG. 1 is a perspective view showing an internal arrangement of a first embodiment of an ink ribbon cartridge in accordance with the present invention.
Figure 2:
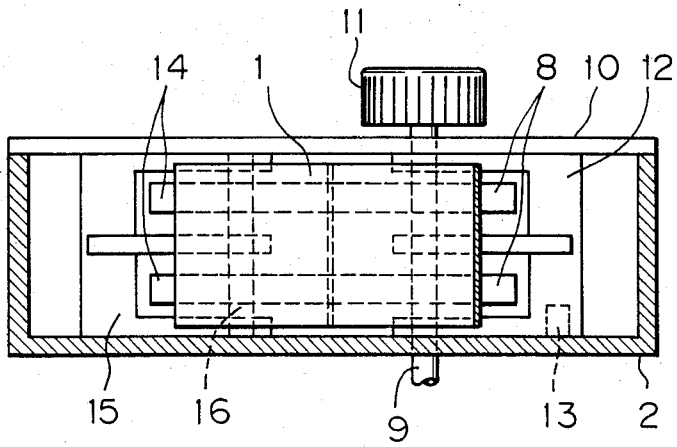
FIG. 2 is an enlarged cross sectional view taken along the line II—II in FIG. 1.
Figure 3:
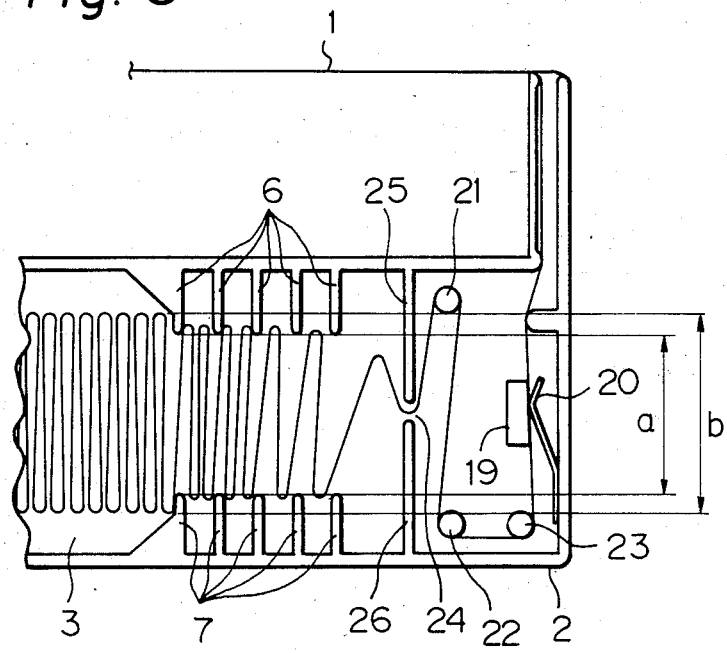
FIG. 3 is an enlarged cross sectional view of the main part in FIG. 1.

The first embodiment of the present invention will now be described hereinbelow with reference to FIGS. 1 to 3. Referring first to FIG. 1, a first embodiment of the ink cartridge of the invention encases an endless ink ribbon denoted by a numeral 1. An enclosing space 3 is formed in the central portion of the cartridge casing 2. Most of the ink ribbon 1 is regularly folded like a zigzag line and is enclosed in the enclosing space 3. A pull-out port 4 through which the ink ribbon 1 is pulled out is protrudingly formed at one end portion of the casing 2. The ink ribbon taken out from the pull-out port 4 is conveyed in the longitudinal direction (indicated by an arrow A in FIG. 1) of the casing 2 and is again taken into the casing through a take-in port 5 formed at the other end of the casing 2. Projections 6 and 7 are formed of thin plate like extensions of the longitudinal side walls of the cartridge casing which are at a plurality of positions on the inner surfaces of the longitudinal side walls of the casing 2 along opposite sides of a conveying path for the ink ribbon so as to be spaced apart and facing each other. In this case, as shown in FIG. 3, a distance a (Namely, a gap between the edge of the projection 6 near the outlet of the enclosing space 3 and the edge of the corresponding opposed projection 7 opposite to this projection 6) is set to be slightly smaller than a folding width b between opposite ends of adjacent folds along the length of the ink ribbon 1. In this embodiment, the projections 6 and 7 are arranged on the foregoing inner surfaces at regular intervals in the folding direction of the ink ribbon 1.

Feed rollers 8 are rotatably and pivotally supported on the side of the take-in port 5 in the cartridge casing 2. A numeral 9 denotes a rotary shaft carrying the feed rollers 8. As shown in FIG. 2, a cover 10 (not shown in FIG. 1) of the cartridge casing 2 is pierced by one end of the rotary shaft 9. A manually operable knob 11 is fixed to this protruded end of the rotary shaft so that the feed rollers 8 can be manually rotated by an operator. On one hand, the cartridge casing 2 is pierced by the other end of the rotary shaft 9, and a drive source (not shown) such as a motor is connected to this protruded end. A feed roller bracket 12 is fixed to the casing 2 by means of a projection 13 provided on the bottom portion of the casing 2. Pressing rollers 14 are arranged for pressure contact with the feed rollers 8 and are rotatably supported on a pressing roller bracket 15 through a rotary shaft 16. As shown in FIG. 1, the bracket 15 is attached to the inner wall of the cartridge casing 2 so that it can be rotated in the direction of the feed rollers 8 as indicated by an arrow C on a shaft 17 formed at one end of the bracket 15 and serving as a fulcrum. The pressing rollers 14 are pressed to the side of the feed rollers 8 at a predetermined pressure by means of a spring 18 arranged between the roller bracket 15 and the inner wall of the casing 2.

A pressing wall 19 is provided on the side of the pull-out port 4 in the cartridge casing 2. A pressing spring 20 is attached to the inner wall of the casing 2 such that one end of this spring is held in contact with the pressing wall 19. Guide pins 21, 22 and 23 are arranged to protrude from the bottom portion of the casing 2 in such a manner that the ink ribbon 1 which is being sent from the enclosing space 3 of the casing 2 can be guided to the gap between the pressing wall 19 and the pressing spring 20. A conveying port 24 is formed by arranging projections 25 and 26 a small distance apart on the inner surfaces of the casing 2 so as to face each other at the positions between the projections 6 and 7 and the guide pins 21, 22 and 23. A roller 27 is also provided to guide the ink ribbon 1 from the take-in port 5 to the gap between the feed rollers 8 and the pressing rollers 14.

The operation of the ink ribbon cartridge having the described arrangement is as follows. First, the ink ribbon 1 pinched by the feed rollers 8 and pressing rollers 14 is sent into the enclosing space 3 as the feed rollers 8 are driven by a suitable driving means (not shown), and, as shown in FIG. 1, the ink ribbon 1 is regularly and sequentially folded like a zigzag line such as to be enclosed in the enclosing space 3. When the enclosed ink ribbon 1 is moved to the conveying port 24, it is hooked on the projections 6 and 7 which form therebetween a distance a smaller than the folding width b of the ink ribbon 1, so that the folding density is gradually reduced as illustrated in FIG. 3, thereby decreasing the load variation due to the pull-out of the ribbon and also preventing the ribbon from falling down in the cartridge casing.

The ink ribbon 1 passed through the conveying port 24 is guided by the guide pins 21 to 23 and then passes through the gap between the pressing wall 19 and the pressing spring 20. The ribbon is pulled out to the outside through the pull-out port 4 and is conveyed in the direction of the arrow A (in FIG. 1) and thereafter it is again taken into the cartridge casing 2 through the take-in port 5.

Figure 4:
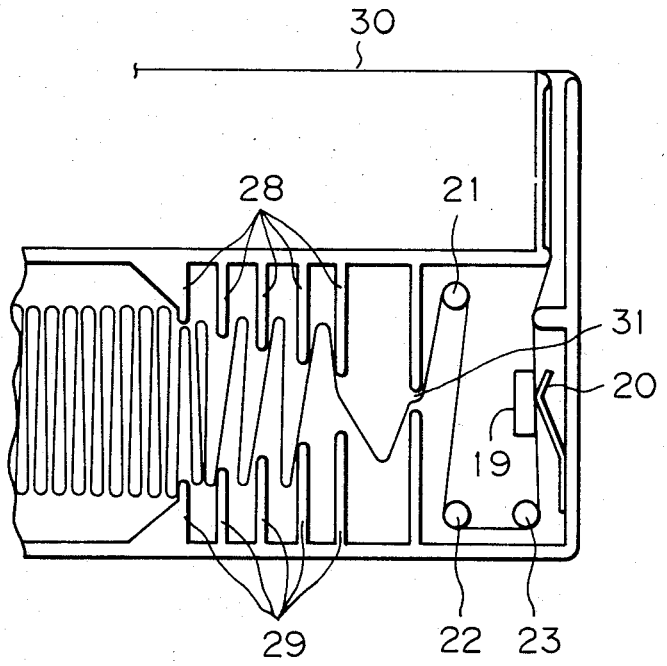
FIG. 4 is an enlarged cross-sectional view of the main part in a second embodiment of the invention.

Although the distance a between the projections 6 and 7 which face each other is set to be constant as shown in FIG. 3 in the foregoing embodiment, this constant distance is not essential. For instance, as shown in FIG. 4 showing another embodiment, each distance between corresponding spaced apart opposed projections 28 and 29 which face one another is likewise set to be smaller than the folding width of an ink ribbon 30 and at the same time, such as to become more narrow at positions towards a conveying port 31. In this case, the braking force on the ink ribbon 30 exerted by the projections 28 and 29 is gradually increased as the ribbon approaches the conveying port 31, thus ensuring safe pulling out of the ink ribbon.

As will be understood from the foregoing description, according to the invention, a plurality of projections are arranged such as to face one another on the inner surface which in the region near the outlet of the enclosing space of the cartridge casing. Each gap which is formed by the projections which face each other is set to be more narrow than the folding width of the ink ribbon. Thus, the folded ink ribbon in the enclosing space of the cartridge casing is hooked on the projections and the folding density of the ink ribbon is gradually reduced by these projections since the folds of the ink ribbon are caught in spaces between adjacent projections before it is taken out of the enclosing space from the conveying port. This arrangement offers the following advantages. Firstly, it is to be noted that the ink ribbon can be stably pulled out with minimal load variation. Secondly, it is possible to prevent the ink ribbon on the outlet side of the enclosing space from falling down or twisting due to the pressing force exerted by the inlet side of the enclosing space or due to the weight of the ink ribbon itself.

Consequently, even if the width of the ink ribbon and/or the rigidity of the ink ribbon has been reduced after a long use of the ink ribbon, the ink ribbon can be pulled out stably as compared with the conventional ink ribbon cartridge.

The present invention is not limited to the foregoing embodiments but many modifications and variations are possible within the spirit and the scope of the appended claims of the invention.

What is claimed is:

1. An ink ribbon cartridge of the fan-folded type in which an ink ribbon is regularly folded to have a constant width length between adjacent folds of the ink ribbon with the ink ribbon received in an enclosing space of a cartridge casing, said ink ribbon cartridge comprising:

a cartridge casing having an enclosing space therein for receipt of regularly folded ink ribbon, said enclosing space including substantially parallel opposed walls with the constant lengths of ink ribbon between folds extending substantially perpendicular to said opposed walls, a pull-out port in communication with said enclosing space with a conveying path therebetween for passage of the ink ribbon out of said cartridge casing, and a take-in port in communication with said enclosing space for passage of the ink ribbon into said cartridge casing;

a pair of exit projections disposed within said cartridge casing positioned along said conveying path between said enclosing space and said pull-out port, said pair of exit projections extending in a direction which is generally perpendicular to said opposed walls of said enclosing space and defining therebetween a gap substantially smaller than the length between adjacent ribbon folds to form a conveying port for passage of the ink ribbon therethrough;

a plurality of paws of spaced opposed projections extending in a direction which is perpendicular to said opposed walls of said enclosing space and positioned between said pair of exit projections and said enclosing space, each of said opposed spaced apart projections of a pair on one side of said conveying path being aligned with and forming a gap with a corresponding one of said opposed spaced apart projections of said pair on the other side of said conveying path for passage of folds of the ink ribbon, said gap being substantially larger than the spacing between said exit projections and slightly smaller than a distance between opposite ends of adjacent folds along the length of the ink ribbon received in said enclosing space and whereby the ink ribbon is prevented from falling down in the cartridge casing and the folding density is decreased in a direction towards the conveying port to reduce the load variation on the ink ribbon so that it can be stabily pulled out of the cartridge casing.

2. The ink ribbon cartridge of claim 1, wherein said gap between all corresponding spaced apart opposed projections is a constant distance.

3. The ink ribbon cartridge of claim 1, wherein said gap between corresponding spaced apart opposed projections is smaller at each position along said conveying path in said cartridge casing closer to said pair of projections.

4. The ink ribbon cartridge of claim 3, wherein each of said plurality of spaced opposed projections comprises a thin plate-like member, said plurality of projections defining spaces between adjacent plate-like members which receive the folds of the ink ribbon to thereby reduce the folding density of the ink ribbon as it approaches said pull-out port.

5. The ink ribbon cartridge of claim 1, wherein each of said plurality of spaced opposed projections comprises a thin plate-like member, said plurality of projections defining spaces between adjacent plate-like members which receive the folds of the ink ribbon to thereby reduce the folding density of the ink ribbon as it approaches said pull-out port.

* * * * *